US009532429B2

(12) United States Patent
Wynnyczenko

(10) Patent No.: US 9,532,429 B2
(45) Date of Patent: Dec. 27, 2016

(54) OPERATING DEVICE FOR LUMINOUS ELEMENTS

(71) Applicant: Tridonic GmbH & Co. KG, Dornbirn (AT)

(72) Inventor: Oliver Wynnyczenko, Lustenau (AT)

(73) Assignee: Tridonic GmbH & Co KG, Dornbirn (AT)

( * ) Notice: Subject to any disclaimer, the term of this patent is extended or adjusted under 35 U.S.C. 154(b) by 0 days.

(21) Appl. No.: 14/787,697

(22) PCT Filed: Apr. 30, 2014

(86) PCT No.: PCT/AT2014/000102

§ 371 (c)(1),
(2) Date: Oct. 28, 2015

(87) PCT Pub. No.: WO2014/176615

PCT Pub. Date: Nov. 6, 2014

(65) Prior Publication Data

US 2016/0073471 A1 Mar. 10, 2016

(30) Foreign Application Priority Data

May 2, 2013 (AT) ..... GM160/2013

(51) Int. Cl.
*H05B 33/08* (2006.01)

(52) U.S. Cl.
CPC ..... *H05B 33/0884* (2013.01); *H05B 33/0815* (2013.01)

(58) Field of Classification Search
None
See application file for complete search history.

(56) References Cited

U.S. PATENT DOCUMENTS

| | | | | |
|---|---|---|---|---|
| 6,765,811 | B1 | 7/2004 | Chang | |
| 8,007,102 | B2 | 8/2011 | De Gaudemaris et al. | |
| 2006/0132061 | A1* | 6/2006 | McCormick | H02M 1/4258 315/291 |
| 2007/0138971 | A1 | 6/2007 | Chen | |
| 2007/0267984 | A1* | 11/2007 | Peng | H05B 33/0803 315/312 |

(Continued)

FOREIGN PATENT DOCUMENTS

| | | | |
|---|---|---|---|
| CN | 102594122 | A | 7/2012 |
| CN | 202310246 | U | 7/2012 |

(Continued)

OTHER PUBLICATIONS

Machine translation of CN 102594122.

(Continued)

*Primary Examiner* — Douglas W Owens
*Assistant Examiner* — James H Cho
(74) *Attorney, Agent, or Firm* — The H.T. Than Law Group

(57) ABSTRACT

Operating device for a luminous element (42), wherein the operating device (50) has a primary side (61) and a secondary side (62) and comprises a radio interference suppression element (59), the radio interference suppression element (59) being arranged between the primary side and the secondary side (62), and a filter (73) for suppressing interference, coupled to the radio interference suppression element (59).

14 Claims, 3 Drawing Sheets

(56) References Cited

U.S. PATENT DOCUMENTS

| | | | | |
|---|---|---|---|---|
| 2008/0278229 | A1 | 11/2008 | Grundl et al. | |
| 2013/0049589 | A1* | 2/2013 | Simi | H05B 33/0815 315/85 |

FOREIGN PATENT DOCUMENTS

| | | | |
|---|---|---|---|
| CN | 103065773 | A | 4/2013 |
| DE | 202012002361 | U1 | 9/2012 |
| GB | 1308133 | A | 2/1973 |
| JP | 2005295700 | A | 10/2005 |
| WO | 2012161795 | A1 | 11/2012 |

OTHER PUBLICATIONS

Machine translation of JP 2005295700.
Machine translation of DE 202012002361.
Machine translation of CN 202310246.
Machine translation of CN 103065773.
International Search Report and Written Opinion issued in connection with International Application No. PCT/AT2014/000102 on Sep. 12, 2014.

* cited by examiner

OPERATING DEVICE FOR LUMINOUS ELEMENTS

FIELD OF THE INVENTION

The invention relates to operating devices for luminous elements. In particular, the invention relates to operating devices in which the operating device comprises a radio interference suppression element.

BACKGROUND OF THE INVENTION

Energy-saving lamps can use light emitting diodes (LEDS) as luminous elements. Such luminous elements can be excited to emit light even by small currents. Operating devices for luminous elements with filter circuits are already used according to the prior art, however, these still require a relatively large filter at the input.

With the prior art, in the case of measurements of the line-related and also radiated emitted interference, it can also occur that the permitted limit values are exceeded. In particular, emitted interference can also occur because of the presence of a separation of potential within the operating device.

SUMMARY OF THE INVENTION

The object of the invention is to provide an operating device for a luminous element, with which interference from the operating device can be effectively suppressed, that is reduced.

This object is achieved by an operating device, a method and a lighting system with the features specified in the independent claims. The dependent claims define further developments of the invention.

An operating device for a luminous element according to one exemplary embodiment comprises a radio interference suppression element and a filter for suppressing interference, which is coupled to the radio interference suppression element. A device for suppressing glow can also be present, which can reduce or completely eliminate the glow. This device for suppressing glow is also designated in the following as an anti-glow device.

Disturbances which are caused, for example, by switching edges generated by the operating device, can be reduced by the filter in the operating device. The transmitted disturbances, which can be caused by the operating device, can also be correspondingly reduced. The embodiment according to the invention also allows a dimming, for example, through pulse-width modulation.

The filter can be connected between the radio interference suppression element and a ground. The filter can comprise a transfer function, of which the magnitude is smaller at a supply-voltage frequency of the supply voltage of the operating device than at frequencies within the radio interference suppression range. The filter can comprise an inductance which is coupled with a radio interference suppression capacitor.

The filter can be embodied as an element with a frequency-dependent impedance. The element with the frequency-dependent impedance can comprise an impedance reduced in magnitude at the supply voltage frequency of the operating device by comparison with a frequency in the radio interference suppression range. The filter can comprise an inductance or also another frequency-dependent component.

The operating device can comprise a primary side and a secondary side. The radio interference suppression element can be a radio interference suppression capacitor between the primary side and the secondary side.

The filter is preferably connected in series to the radio interference suppression capacitor. For example, a disturbance can arise because leakage currents occur at the supply-voltage frequency through a coupling capacitance between the LED module and an earthed lamp housing. A corresponding current circuit can be formed by the voltage between phase conductor and ground on a primary side of the operating device, by the radio interference suppression capacitor and the coupling capacitor between the LED module and ground.

The filter and the radio interference suppression element are arranged in a series circuit. This series circuit comprising filter and radio interference suppression element is arranged between the the ground of the primary side and the ground of the secondary side.

The operating device can comprise an earth connection. A series circuit comprising a filter capacitor and a radio interference suppression choke can be arranged between the earth connection and the ground of the secondary side (also designated in the following as the secondary-side ground).

A safety capacitor can be arranged between the earth connection and the earth potential of the primary side.

With the optional anti-glow device, the radio interference suppression capacitor can be selectively disconnected and this current circuit can be interrupted in order to reduce or completely eliminate the glow of the luminous element. With such an embodiment, the current to or from the radio interference suppression element can be conducted or interrupted dependent upon a signal shape. In the standby mode of the operating device, very few disturbances or no disturbances caused by the operating device as a result of switching edges occur, accordingly, no interference suppression is required in this operating mode. When the lamp is switched on, signals at frequencies which are disposed within the radio interference suppression range can be conducted to ground by the radio interference suppression element. The filter can comprise a diode with a high reverse recovery time or can be embodied as such a diode.

The optional anti-glow device can be set up to influence a current flow to or from the radio interference suppression element. The anti-glow device can be set up to influence the current flow to or from the radio interference suppression element dependent upon the operating status. The anti-glow device can be set up to reduce a current flow between the radio interference suppression element and a ground, when the operating device is disposed in a standby mode and/or when the lamp is switched off.

The anti-glow device can comprise a controllable switching means, which can be switched between the radio interference suppression element and a ground. The anti-glow device can be connected in series to the radio interference suppression element. The switching means can comprise a transistor, for example, a field-effect transistor (FET).

The operating device can be set up so that the controllable switching means is switched into an ON-condition and/or an OFF-condition dependent upon operating status. The operating device can be set up in such a manner that the controllable switching means between the radio interference suppression element and the ground is switched into an OFF-condition when the lamp is switched off and/or the operating device is disposed in a standby mode. The operating device can be set up in such a manner that the controllable switching means between the radio interference element and the ground is switched into an ON-condition when the lamp is switched on.

The controllable switching means can be coupled with a microcontroller, a controller or processor or another integrated semiconductor circuit which is provided respectively on a secondary side of the operating device.

The controllable switching means can be configured in such a manner that it is switched selectively into an ON-condition by the microcontroller, the controller, the processor or the other integrated semiconductor circuit. In this manner, it can be ensured that the radio interference suppression element is disconnected when the operating device is in a standby mode and the microcontroller on the secondary side is not supplied with energy. Alternatively or additionally, the controllable switching means can be switched into an ON-condition by a voltage of a secondary side of the operating device.

The filter can be arranged on the secondary side of the operating device. The filter can be provided between a radio interference suppression capacitor and a ground of the secondary side of the operating device.

The operating device can be embodied as an insulated LED converter.

According to a further exemplary embodiment, a lighting system is specified. The lighting system comprises an operating device according to an exemplary embodiment of the invention.

The lighting system comprises a power-supply source connected to the operating device and a luminous element connected to the operating device.

According to a further exemplary embodiment, a method for suppressing interference through the operating device is specified. The luminous element is coupled to an operating device which comprises a radio interference suppression element. The method comprises an influencing of a current flow to or from the radio interference suppression element dependent upon an operating status of the operating device and/or dependent upon a signal frequency.

Additional features of the method specified in exemplary embodiments and the effects achieved in each case correspond to the additional features of the operating devices specified in the exemplary embodiments.

Further features, advantages and functions of exemplary embodiments of the invention are disclosed in the following detailed description on the basis of the attached drawings, in which identical or similar reference numbers designate units with identical or similar function.

DETAILED DESCRIPTION OF THE PREFERRED EMBODIMENTS

Figure 1:
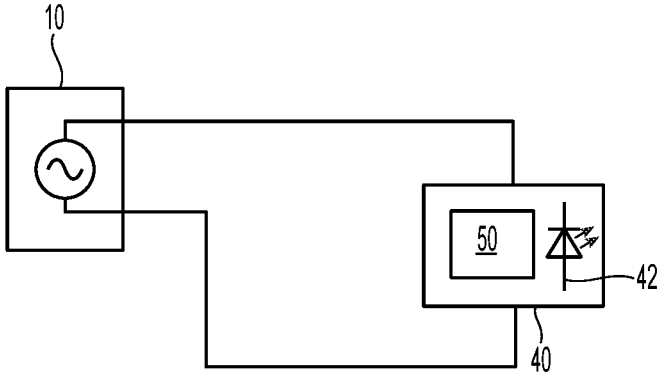
FIG. 1 shows a lighting system with an operating device for a luminous element according to an exemplary embodiment of the invention.

FIG. 1 shows a lighting system with an operating device for a luminous element according to an exemplary embodiment of the invention. The lighting system comprises a power-supply source 10, for example, a mains-voltage source, and a lamp 40 or several lamps 40. The lamp 40 comprises an operating device 50 according to an exemplary embodiment and a luminous element 42. The luminous element 42 can comprise one or more light emitting diodes (Leeds). Correspondingly, the operating device 50 can be embodied as an LED converter. The luminous element 42 can be implemented in various ways, for example, through one or more inorganic Leeds, organic Leeds, other luminous elements or a combination of the named types of luminous element. An appropriate operation of the respective luminous element 42 is implemented via the operating device 50. For this purpose, the operating device 50 can comprise, for example, a power-supply unit, which generates from a supply voltage supplied to the lamp 40 an appropriate voltage and/or an appropriate current for the operation of the luminous element 42. A housing of the lamp 40 can be earthed.

As will be described in greater detail with reference to FIG. 2 to FIG. 7, the operating device 50 comprises a radio interference suppression element and a filter for suppressing interference, and, optionally, an anti-glow device for suppressing glow.

Figure 2:
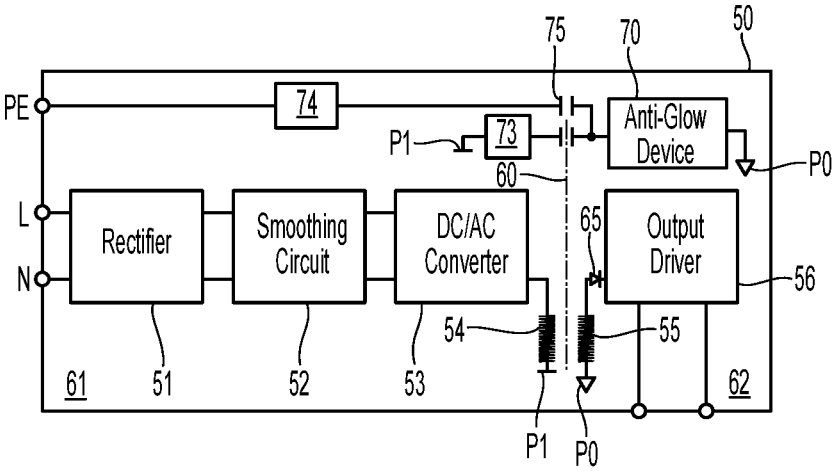
FIG. 2 is a block diagram of an operating device according to an exemplary embodiment.

FIG. 2 is a block-diagram view of an operating device 50 according to an exemplary embodiment. The operating device 50 can operate as a constant current source or as a constant voltage source. The operating device 50 can be an LED converter. The operating device 50 can be an insulated LED converter.

At the input end, the operating device 50 comprises a rectifier 51. A line filter (not shown) is preferably connected upstream of the rectifier 51. The line filter can be formed, for example, from an LC filter or a CLC filter. The rectified supply voltage at the input of the operating device can be smoothed by a smoothing circuit 52 (also designated as a power-factor correction circuit or PFC circuit). With the smoothing circuit 52, a power factor correction can be implemented in such a manner that the total harmonic distortion (THD) is reduced and the power factor is increased. A DC-AC converter 53 can be controlled, for example, by a microcontroller, controller, processor or another integrated semiconductor circuit on a primary side of the operating device. The DC-AC converter 53 can comprise an LLC resonance converter, a blocking-oscillator type converter or another converter topology. The operating device can comprise a transformer with a primary-side coil 54 and a secondary side coil 55 inductively coupled with the latter. The primary-side coil 54 is arranged on a primary side 61 of the operating device 50. The secondary side coil 55 is arranged on a secondary side 62 of the operating device 50. The transformer can create a galvanic separation. The secondary side 62 can be an SELV ("safety extra-low voltage") side of the operating device, which is separated from the primary side 61 by an SELV barrier 60 or another galvanic separation. The secondary-side coil 55 is preferably followed by an output rectifier, for example, a one-way rectifier 65 or a diode bridge. This output rectifier can also be embodied as an active rectifier. The DC-AC converter 53, the transformer with the primary-side coil 54 and the secondary-side coil 55 inductively coupled to the latter and the output rectifier together form a DC-DC converter. An output driver 56 can be coupled with the secondary-side coil 55. Outputs of the operating device 50 can be connected in an electrically conducting manner to the luminous element 42, for example, to an LED module. The operating device 50 can also comprise, for example, only a DC-DC converter. The rectifier 51, the smoothing circuit 52 and the output driver 56 are optional elements of which the function can also be integrated in the DC-DC converter.

The operating device 50 comprises a radio interference suppression element. With the illustrated embodiment, the radio interference suppression element is embodied as a radio interference suppression capacitor 59. The radio interference suppression capacitor 59 is connected in series with a filter 73 between the primary side 61 and the secondary side 62. The filter 73 is connected to the earth potential P1 of the primary side 61. The radio interference suppression capacitor 59 is connected to the secondary-side earth potential P0. The filter 73 and the radio interference suppression element 59 are arranged in a series circuit, and this series circuit comprising filter 73 and radio interference suppression element 59 is arranged between the ground P1 of the primary side 61 and the ground P0 of the secondary side 62. With the radio interference suppression capacitor 59 and the filter 73, high-frequency interference signals from the power lines and lamp lines can be conducted away, at least in the payload operating mode when the lamp 40 is switched on. As a result, for example, electromagnetic disturbances can be reduced. The high-frequency interference signals can be caused, for example, by the operation of one or more switching controllers, for example, of the DC-AC converter 53 or other components of the operating device 50. Furthermore, the operating device 50 comprises a radio interference suppression choke 74 which is connected at one end to the earth connection PE for protective earthling and, at the other end, via a filter capacitor 75 to the secondary-side earth potential P0 of the operating device.

As already mentioned, the operating device 50 comprises a filter 73 and optionally an anti-glow device 70. The filter 73 is coupled with the radio interference suppression element 59. The function of the filter 73 will be described in greater detail with reference to the example of FIG. 5. The anti-glow device 70 is coupled with the radio interference suppression element. The filter 73 and the anti-glow device 70 can be set up to influence, for example, to block in a selective manner, currents between the radio interference suppression element and a secondary-side earth potential P0. This can be implemented dependent upon an operating status of the lamp or of the operating device. Alternatively or additionally, the current flow between the radio interference suppression element and a secondary-side earth potential P0 can be blocked in a frequency-dependent manner. The filter 73 can be embodied in such a manner that it attenuates high-frequency disturbances which are generated by the operating device, at least when the operating device 50 is disposed in the payload operating mode. The filter 73 can be embodied, for example, in such a manner that currents at a radio interference suppression frequency between the radio interference suppression element 59 and the secondary-side earth potential P0 can be attenuated, at least when the lamp 40 is switched on.

Embodiments of the filter and of the optional anti-glow device 70 in operating devices according to exemplary embodiments will be described in greater detail with reference to FIG. 3 to FIG. 7.

Figure 3:
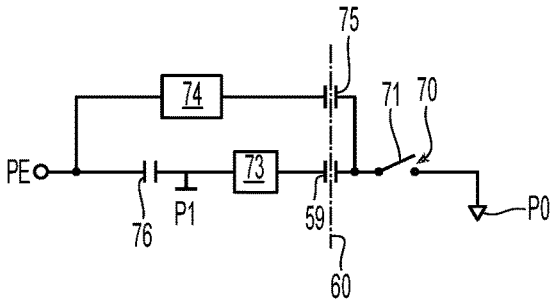
FIG. 3 is a circuit diagram of a filter device for an operating device according to an exemplary embodiment.

FIG. 3 is a circuit diagram of a filter device with the filter 73 and an optional anti-glow device 70 in an operating device according to an exemplary embodiment. The anti-glow device 70 comprises a switching means 71. The switching means 71 can be arranged on the secondary side 62 of the operating device. The switching means 71 can comprise a transistor, for example, an FET or another power switch. The switching means 71 can connect the radio interference suppression capacitor 59 in a conducting manner to a secondary-side earth potential P0 when it is switched into an ON-condition. The radio interference suppression capacitor 59 is connected in series to a filter 73. The filter 73 is preferably arranged on the primary side, however, it can also be arranged on the secondary side. Furthermore, a radio interference suppression choke 74 is present, which is connected at one end to the earth connection PE for the protective earthing and at the other end via a filter capacitor 75 to the secondary-side earth potential P0 of the operating device. The radio interference suppression choke 74 can also be arranged on the secondary side 62, as illustrated by way of example in the example of FIG. 8. A safety capacitor 76, which serves to reduce disturbances of the operating device 50, can be arranged between the earth connection PE for the protective earthing and the earth potential P1 of the primary side 61. The safety capacitor 76 can also conduct high-frequency interference signals to the earth connection PE or the neutral conductor N or can short them and accordingly achieves a reduction of the electromagnetic disturbances.

The switching means 71 can be controlled in such a manner that a resistance of the switching means 71 is controlled dependent upon an operating condition. The resistance of the switching means 71 can be selectively reduced when the lamp 40 is switched on and/or when the operating device 50 is not disposed in a standby mode and supplies energy to the luminous element. Accordingly, the radio interference suppression capacitor 59 is connected in order to conduct interference signals away to the secondary-side earth potential P0. The resistance of the switching means 71 can be selectively increased when the lamp 40 is switched off and/or when the operating device 50 is disposed in a standby mode. Accordingly, the switching means 71 can be switched into an OFF-condition. In this manner, the radio interference suppression capacitor 59 can be disconnected in order to suppress a glowing of the luminous element or to prevent an interference injection via the radio interference suppression capacitor 59.

The switching means 71 can be provided in such a manner that it is switched into the ON-condition dependent upon a voltage or a current at the output of the operating device. For this purpose, for example, a gate of the switching means 71 can be coupled to an operating voltage of the secondary side 62.

The switching means 71 can be provided in such a manner that it is controlled by a microcontroller, a controller, a processor or another integrated semiconductor circuit. A gate of the switching means 71 can be coupled to a microcontroller which is arranged on the secondary side 62 of the operating device 50. The microcontroller can be coupled to the secondary-side coil 55 in order to be supplied with energy by the latter. Correspondingly, the microcontroller only controls the switching means 71 in such a manner that it is switched into an ON-condition when the microcontroller of the secondary side is also supplied with energy. This can ensure that the radio interference suppression element is selectively disconnected when the lamp is switched off and/or the operating device is in a standby mode.

Figure 4:
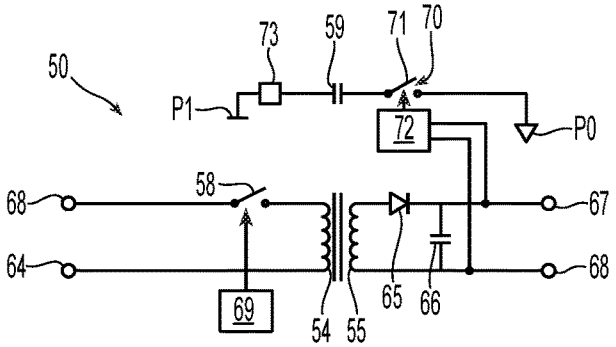
FIG. 4 is a circuit diagram of an operating device with a filter device according to an exemplary embodiment.

FIG. 4 shows a circuit arrangement of components of an operating device 50 according to an exemplary embodiment. In this context, a converter with a blocking-oscillator type converter topology is shown by way of illustration. The converter shown in this exemplary embodiment represents an example of a DC-DC converter. Other types of converter can be used. In the case of the converter, a switching means 58 is activated in order to store energy in the primary-side coil 54 (that is, in order to charge the primary-side coil 54) or in order to transfer energy from the primary-side coil 54 to the secondary-side coil 55 (that is, in order to discharge the primary-side coil 54). The switching means 58 can be controlled by a microcontroller 69 on the primary side of the operating device 50. Instead of a microcontroller 69, a controller, a processor or another integrated semiconductor circuit can also be used. The switching means 58 and the microcontroller 69 form a DC-AC converter 53 which feeds the primary-side coil 54. On the secondary side, a charging capacitor 66 can be charged via a diode 65 as the output rectifier, which is connected to the secondary-side coil 55. Current can be output to the luminous element via output connections 67, 68 of the operating device 50. The microcontroller 69 can control the switching means 58 in such a manner that a constant current is generated in order to supply LEDs from a rectified supply voltage at inputs 63, 64 of the converter. The radio interference suppression capacitor 59 is connected in series to a filter 73. The filter 73 is preferably arranged on the primary side, however, it can also be arranged on the secondary side.

A further microcontroller 72 is provided on the secondary side of the operating device. The further microcontroller can be supplied with energy from an operating voltage of the secondary side. The further microcontroller 72 can be set up to switch the switching means 71 from an OFF-condition into an ON-condition when energy for the luminous element is supplied via the output connections 67, 68.

The further microcontroller 72 can be set up in such a manner that the switching means 71 is switched into an OFF-condition when the lamp is switched off and/or the operating device is disposed in a standby mode.

The further microcontroller 72 is separated from the microcontroller 69 of the primary side and can perform further control functions. Instead of the microcontroller 72, a controller, a processor or another integrated semiconductor circuit can also be used.

Figure 5:
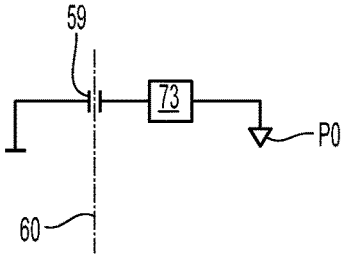
FIG. 5 is a circuit diagram of a filter device for an operating device according to an exemplary embodiment.

FIG. 5 is a circuit diagram with a filter 73 in an operating device according to a further exemplary embodiment. In addition to the filter 73, an anti-glow device 70 can also be present. However, this is optional and is therefore not shown in this example. The filter 73 can be arranged on the secondary side 62 of the operating device. The filter 73 can be set up to block signals dependent upon a signal shape and, in particular, dependent upon a frequency. The filter 73 can be set up in such a manner that signals of which the frequency corresponds to a supply-voltage frequency of the voltage provided by the supply source 10 are attenuated. Such signals can be blocked by the filter 73. The filter 73 can optionally comprise a diode with a high reverse-recovery time. The filter 73 can comprise an inductance. The inductance of the filter 73 can be selected dependent upon a capacitance of the radio interference suppression capacitor 59 in such a manner that signals at the supply-voltage frequency are attenuated.

The filter 73 can be embodied in such a manner that a magnitude of an impedance of the filter 73 at the supply-voltage frequency is larger than a magnitude of the impedance of the filter 73 at least at a frequency within the radio interference range. The filter 73 can be embodied in such a manner that a magnitude of an impedance of the filter 73 at the supply-voltage frequency is larger than a magnitude of the impedance of the filter 73 at all frequencies within a radio interference range. Correspondingly, the filter 73 can comprise a transmission function, of which the magnitude at the supply-voltage frequency is smaller than at frequencies within the radio interference range. With the filter 73, the conductive pathway between the radio interference suppression capacitor 59 and the secondary-side earth potential P0 can be blocked, for example, for signals at a line frequency which can cause a glowing of the luminous element. Because of the relatively smaller impedance for relatively higher frequency interference signals, such interference signals can be conducted via the filter 73 away to the secondary-side earth potential P0. This can take place, for example, when the lamp is switched on and the switching controllers of the operating device 50 are in operation.

The inductance of the filter 73 can be formed by an SMD component and preferably fitted to the printed-circuit board of the operating device by a pick-and-place machine. The inductance of the filter 73 can also be formed by a radial component which can preferably be fitted to the printed-circuit board of the operating device by a pick-and-place machine. The radio interference suppression capacitor 59 and the filter 73 or parts thereof such as the inductance can also be integrated in a hybrid component.

The radio interference suppression capacitor 59 and the filter 73 can achieve a reduction or respectively compensation of the emitted interference from the operating device.

The reduction or respectively compensation of the emitted interference can be achieved through a corresponding leakage inductance of the inductance of the filter 73. The reduction or respectively compensation of the emitted interference can be achieved through a resonance effect of the radio interference suppression capacitor 59 and the inductance of the filter 73.

The filter 73 according to the invention need not be connected to the optional anti-glow device 70. According to the invention, the operating device 50 comprises at least one radio interference suppression capacitor 59 and the filter 73. These two components serve for the suppression of interference. The anti-glow device 70 is only an optional feature and not absolutely necessary for the suppression of interference.

Figure 6:
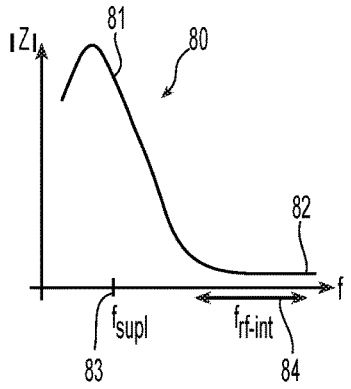
FIG. 6 illustrates an exemplary impedance of a filter of the filter device for an operating device according to an exemplary embodiment.

By way of example, FIG. 6 shows the frequency-dependent characteristic 80 for the magnitude of the impedance of a filter 73 which can be used in operating devices according to exemplary embodiments. With a supply voltage frequency 83, the filter comprises an impedance with a magnitude 81. The value is larger than a magnitude 82 of the impedance of the filter 73 for the frequencies in a radio interference suppression range 84.

With the series circuit according to the invention comprising a radio interference suppression capacitor 59 and filter 73, the input-end line filter (at the line connections) can provide relatively smaller dimensions and the disturbances which the operating device 50 emits can be reduced. As a part of the input-end line filter circuit, the input-end capacitor can also provide relatively smaller dimensions.

According to the invention, it is possible to dispense with an external configuration of the operating device 50 with additional filter components, such as external chokes.

Furthermore, the arrangement of the series circuit comprising a radio interference suppression capacitor 59 and a filter 73 inside the operating device 50 offers the advantage that this filter circuit can be adjusted in an optimal manner to the luminous element to be connected, to its rated power and to the operating frequency of the operating device 50, and, in fact, even at the time of manufacture of the operating device 50.

Furthermore, the series circuit according to the invention comprising a radio interference suppression capacitor 59 and a filter 73 in the operating device 50 allows a simple wiring and installation, because, at the time of connection, the electrician need no longer additionally connect or wire any external components, and the wiring of the operating device 50 is also kept simpler.

Figure 7:
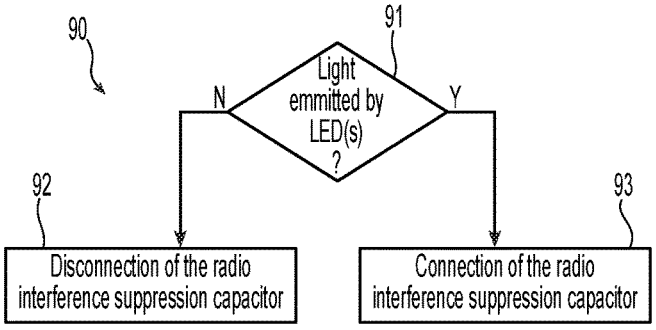
FIG. 7 is a flow diagram of a method according to an exemplary embodiment.

FIG. 7 is a flow diagram of a method 90 according to an exemplary embodiment. According to one exemplary embodiment, the method 90 can be executed automatically by the operating device 50. With the method, a glowing of a luminous element can be suppressed dependent upon an operating condition.

In step 91, it is determined whether a light emission via LEDs is taking place. For this purpose, it is possible to investigate whether the lamp is switched on. An operating voltage on a secondary side of the operating device can be monitored. Other criteria can be checked in order to investigate whether a glowing of the LEDs should be suppressed.

In step 92, a radio interference suppression element, for example, a radio interference suppression capacitor, can be disconnected if glowing is to be suppressed. This can be achieved in that a conduction pathway between the radio interference suppression element and an earth potential is high-ohmic, at least for signals at the supply-voltage frequency. A switching means between the radio interference suppression element and the earth potential can be switched into an OFF-condition. The switching means can be embodied in such a manner that it is transferred automatically into a blocking condition when no control signal is present at a gate of the switching means. In this manner, the switching means can be switched into the OFF-condition because a control signal for the control of the switching means has not been set.

In step 93, the radio interference suppression element can be connected if the glowing of the luminous element need not be suppressed, for example, when the lamp is switched on.

This can be achieved in that line pathway between the radio interference suppression element and an earth potential is low-ohmic at least for frequencies in a radio interference suppression range. A switching means between the radio interference suppression element and the earth potential can be switched into an ON-condition.

Figure 8:
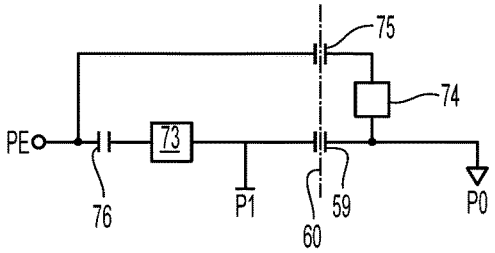
FIG. 8 is a circuit diagram of a filter device for an operating device according to an exemplary embodiment.

FIG. 8 is a circuit diagram with a filter 73 in an operating device according to a further exemplary embodiment. In addition to the filter 73, an anti-glow device 70 can also be present on the secondary side 62. However, this is optional and is therefore not shown in the example. The filter 73 is arranged on the primary side 61 of the operating device and connected in series to one a radio interference suppression capacitor 59, which is connected on the secondary side 62 to the secondary side earth potential P0. The filter 73 is connected to the earth potential P1 of the primary side 61. The filter 73 can be set up to block signals dependent upon a signal shape and, in particular, dependent upon a frequency. A radio interference suppression choke 74 is connected to the nodal point of secondary side earth potential P0 and radio interference suppression capacitor 59, which is connected with its other connection via a filter capacitor 75 to the earth connection PE for the protective earthing of the operating device. The radio interference suppression choke 74 can be set up to block signals dependent upon a signal shape and, in particular, dependent upon a frequency. Accordingly, the filter 73 and also the radio interference suppression choke 74 can serve to suppress high-frequency disturbances. A safety capacitor 76 which serves to reduce disturbances of the operating device 50 is arranged between the earth connection PE for the protective earthing and the earth potential P1 of the primary side 61. The safety capacitor 76 can also conduct high-frequency interference signals away to the earth connection PE or to the neutral conductor N or can short them, and therefore achieves a reduction of the electromagnetic disturbances. In this example, the filter 73 is arranged between the earth connection PE to the safety capacitor 76 and the earth potential P1 of the primary side 61. This arrangement is a possible alternative to the arrangement of the filter 73 between the earth potential P1 of the primary side 61 and the radio interference suppression capacitor 59.

The inductance of the radio interference suppression choke 74 can be formed by an SMD component and can preferably be fitted to the printed circuit board of the operating device by a pick-and-place machine. The inductance of the radio interference suppression choke 74 can also be formed by a radial component which can preferably be fitted to the printed circuit board of the operating device by a pick-and-place machine. The filter capacitor 75 and the radio interference suppression choke 74 or parts thereof, such as the inductance, can also be integrated in a hybrid component.

While operating devices according to exemplary embodiments have been described in detail with reference to the Figs., variations can be realised in other exemplary embodiments. For example, while exemplary embodiments in which the radio interference suppression element is embodied as a capacitor have been described in detail, other embodiments and/or arrangements of the radio interference suppression element can also be used.

Operating devices and methods according to exemplary embodiments can be used, in particular, for the operation of lamps which comprise LEDs, but without being restricted to the latter.

The invention claimed is:

1. An operating device for a luminous element (42), wherein the operating device (50) comprises a primary side (61) and a secondary side (62), comprising:

a radio interference suppression element (59), wherein the radio interference suppression element (59) is arranged between the primary side and the secondary side (62), and a filter (73) for suppressing interference, which is coupled with the radio interference suppression element (59), wherein the operating device (50) comprises an earth connection (PE), and a series circuit comprising a filter capacitator (75) and a radio interference suppression choke (74) is arranged between the earth connection (PE) and a ground (P0) of the secondary side (62).

2. The operating device according to claim 1, wherein the filter (73) comprises an element with a frequency-dependent impedance (80).

3. The operating device according to claim 1, wherein the filter (73) and the radio interference suppression element (59) are arranged in a series circuit, and wherein this series circuit comprising the filter (73) and the radio interference suppression element (59) is arranged between a ground (P1) of the primary side (61) and the ground (P0) of the secondary side (62).

4. The operating device according to claim 1, wherein a controllable switching means (71) is additionally present, which is connected in series to the radio interference suppression element (59) and to the filter (73).

5. The operating device according to claim 4, wherein the operating device (50) is set up to switch the controllable switching means (71) into an ON-condition or an OFF-condition dependent upon the operating status of the operating device or of a lamp, which comprises the operating device.

6. The operating device according to claim 4, wherein the controllable switching means (71) is set up to be switched into an ON-condition by a microcontroller (72) or by a voltage of a secondary side (62) of the operating device (50).

7. The operating device according to claim 4, wherein the controllable switching means (71) is a part of an anti-glow device (70; 71, 72; 73).

8. The operating device according to claim 7, wherein the filter (73) comprises a larger magnitude of the impedance (81) at a supply-voltage frequency (83) of the operating device (50) than for a frequency within the radio interference suppression range (84).

9. The operating device according to claim 7, wherein the anti-glow device (70; 71, 72; 73) is arranged on the secondary side (62) of the operating device (50).

10. The operating device according to claim 4, wherein the controllable switching means (71) is present between the radio interference suppression element (59) and the ground (P0).

11. The operating device according to claim 1, wherein the radio interference suppression element (59) is a radio interference suppression capacitor.

12. The operating device according to claim 1, wherein a safety capacitor (76) is arranged between the earth connection (PE) and a ground (P1) of the primary side (61).

13. The operating device according to claim 1, wherein the operating device (50) is embodied as an LED converter.

14. A lighting system, comprising an operating device (50) according to claim 1, a power-supply source (10) connected to the operating device (50), and a luminous element (42) connected to the operating device (50).

* * * * *